United States Patent [19]

Boss

[11] 4,211,148

[45] Jul. 8, 1980

[54] HOT GAS MOTOR

[75] Inventor: Raymond E. Boss, Ridgecrest, Calif.

[73] Assignee: The United States of America as represented by the Secretary of the Navy, Washington, D.C.

[21] Appl. No.: 945,951

[22] Filed: Sep. 26, 1978

[51] Int. Cl.[2] ..... F01B 13/04

[52] U.S. Cl. ..... 91/499

[58] Field of Search ..... 91/499, 505, 506

[56] References Cited

U.S. PATENT DOCUMENTS

| | | | |
|---|---|---|---|
| 2,248,449 | 7/1941 | Dudley | 91/499 |
| 2,976,863 | 3/1961 | Buer et al. | 91/499 |
| 3,256,782 | 6/1966 | Ebert | 91/505 |
| 3,272,079 | 9/1966 | Bent | 91/499 |
| 3,744,377 | 7/1973 | Lauch | 91/499 |
| 4,092,905 | 6/1978 | Wood | 91/499 |

FOREIGN PATENT DOCUMENTS

| | | | |
|---|---|---|---|
| 655976 | 1/1963 | Canada | 91/499 |
| 1093674 | 11/1959 | Fed. Rep. of Germany | 91/499 |
| 22519 | 1/1962 | German Democratic Rep. | 91/499 |

*Primary Examiner*—William L. Freeh

*Attorney, Agent, or Firm*—R. S. Sciascia; W. Thom Skeer; K. G. Pritchard

[57] ABSTRACT

A multi cylinder, rotary valve, hot gas or fluid powered motor. An inner body having an output shaft, a plurality of cylindrical chambers, a corresponding plurality of sliding pistons, one within each chamber, and a pivot plate for supplying a reaction force to the pistons are mounted for rotation within a housing. A rod, attached within the housing, guides pressurized gas to the inner body through a rotary valve to supply the pressurized gas sequentially to the cylindrical chambers. Gas pressure on the piston and piston force against an angled pivot plate creates uncountered reaction forces tending to rotate the pivot plate and inner body. An output shaft attached to the inner body rotates to produce useful work.

6 Claims, 4 Drawing Figures

$\theta$ = PIVOT PLATE INCLINE ANGLE
$F_P$ = PISTON FORCE
$F_N$ = REACTION NORMAL FORCE=N
N = NORMAL FORCE
$\mu$ = COEFFICIENT OF FRICTION
$\mu N$ = FRICTIONAL FORCE
$F_{RA}$ = AXIAL REACTION FORCE
$F_{RT}$ = TANGENTIAL REACTION FORCE

HOT GAS MOTOR

BACKGROUND OF THE INVENTION

1. Field of the Invention

The present invention pertains to fluid powered motors having a plurality of cylinder/piston pairs. More particularly, the present invention pertains to such motors which use a rotating angled plate to reciprocate the pistons.

2. Description of the Prior Art

Fluid pressure operated motors having a plurality of pistons reciprocating in cylinders arranged around an output shaft and being connected to a wobble plate by means of connecting rods are known in the art. One example of such a motor is illustrated and described in U.S. Pat. No. 3,272,079 to J. H. Bent. The motor there described uses pistons and cylinders which do not rotate relative to the housing of the motor, and uses a driveshaft having an angled end portion. A wobble plate bears against each connecting rod and is joined to the angled end of the main driveshaft by a double row ball bearing assembly. This structure enables transmission and translation of reciprocating piston motion to rotary shaft motion.

Other gas or fluid powered motors, such as compressed air motors, utilize a plurality of pistons operating against angled surfaces according to a predetermined sequence to produce rotary motion from gas pressure and linear piston motion. Commonly, however, prior devices require large amounts of precision machining and large numbers of parts to produce motors having reasonable operating life spans. Applications where expected motor life span is of short duration cannot economically utilize precision along life motors. Also, existing gas or fluid powered motors require manual timing and a break in period before useful operation is achieved. The precision tolerances and clearances normally incorporated in such a gas or fluid powered motor dictates the need for specific design for use with either hot or cold gas, but not both because of differing rates of thermal expansion of the various precision fitted parts. Thus, existing motors of this type are expensive to produce and operate, and must be optimized for a limited range of operating conditions.

SUMMARY OF THE INVENTION

The foregoing, and other problems inherent in the prior art gas or fluid powered motors have been overcome by the present invention which requires a minimum of parts and machining operations to construct and which is operable over a wide range of pressurized gas inlet temperatures. A plurality of pistons, each having a conical end, reciprocate within cylindrical chambers in an inner body, and the conical ends bear against a flat annular contact surface on a pivot plate which rotates with the pistons and inner body. An output shaft attached to the inner body extends through a housing within which the pivot plate, pistons, and inner body are mounted for rotation, and carries an output gear which provides means for coupling the motor output to other mechanisms. The pivot plate rotates about an axis which intersects the axis of rotation of the inner body and output shaft. Gas pressure ducted into the motor is selectively fed to each cylindrical chamber, in turn, according to the relative rotational position of the inner body relative to the housing.

The angled pivot plate enables the piston to stroke, and reciprocates the pistons between the first and second positions according to the relative rotational position of the inner body relative to the housing. A lateral passageway in the rod which ducts input fluid to the motor, aligns with separate passageways in the inner body which each lead to a different cylindrical chamber according to a predetermined sequential order. This motor is timed so that pressurized gas is applied to each cylindrical chamber in sequence, a predetermined time before the piston in that chamber is returned by the pivot plate to the first or retracted position. Gas pressure then causes the piston to apply force against the angled pivot plate and results in uncountered forces perpendicular to the axis of the piston which cause rotation of the inner body and pivot plate.

As the piston strokes to approach the second piston a relieved portion of the rod aligns with the separate passage for that cylindrical chamber, and as the pivot plate returns that piston to the first position, gas within that cylindrical chamber is vented through the separate passageway for that chamber, past the rod into the central cavity of the housing, and out an exhaust gas vent in the housing.

This construction simplifies the internal mechanism of a gas powered motor, and utilization of metallic alloys having low coefficients of thermal expansion enable use of either hot or cold gas as an operating fluid without significant changes in motor efficiency caused by increased gas leakage or increased friction resulting from thermally induced changes to internal motor component dimensions.

BRIEF DESCRIPTION OF THE DRAWINGS

Many of the attendant advantages of this invention will be readily appreciated as the same becomes better under stood by reference to the following detailed description when considered in connection with the accompanying drawing figures, wherein.

DESCRIPTION OF THE PREFERRED EMBODIMENT

Figure 1:
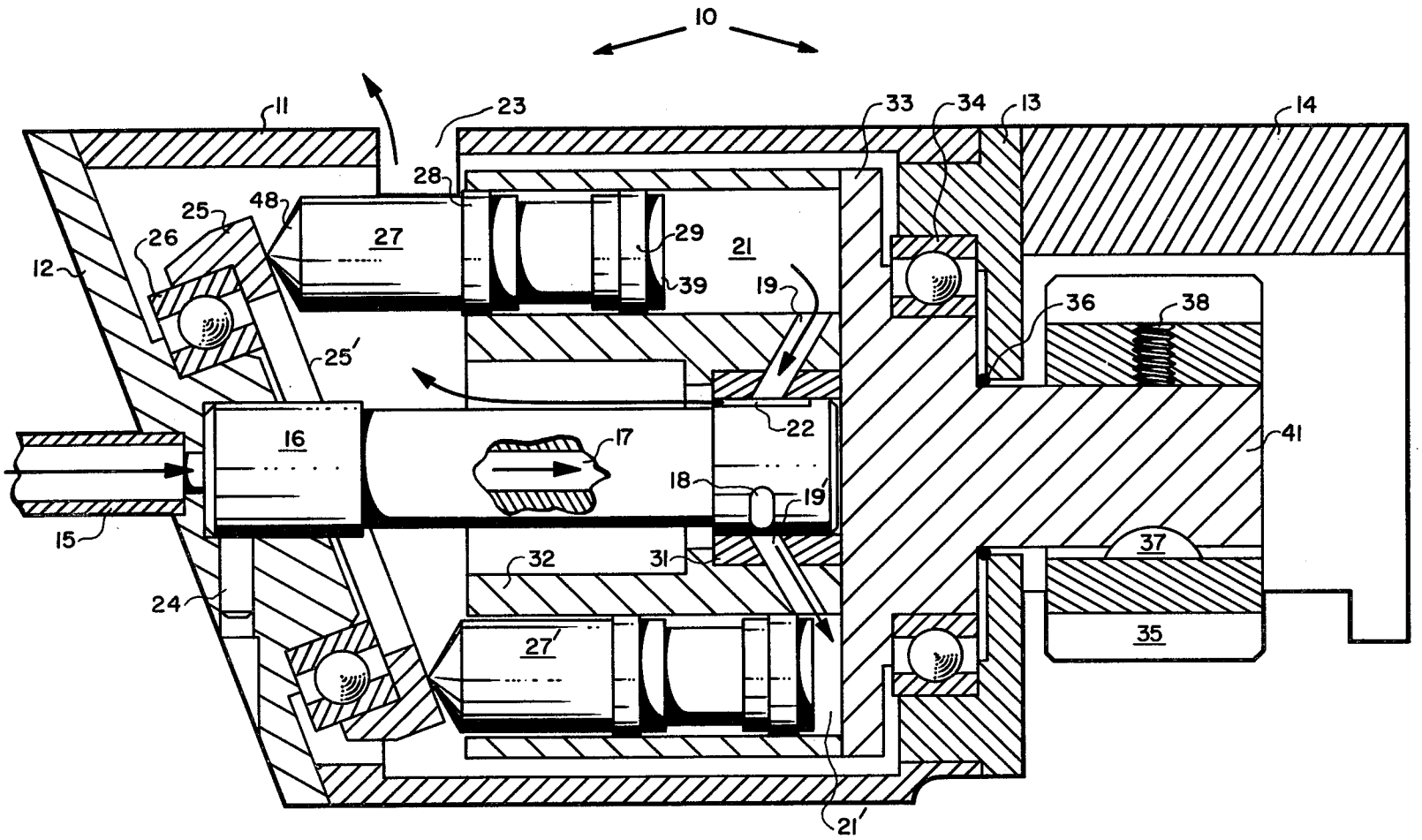
FIG. 1 illustrates a longitudinal sectional view of a gas powered motor according to the inventions.

Referring now to the drawing, wherein like reference characters correspond to like parts and elements throughout the several views there is shown in FIG. 1 a gas powered motor 10. A housing is defined by input end plate 12 and output end plate 13, together with cylindrical case 11. Output end plate 13 may be joined to cylindrical case 11 by means of welding, mechanical fasteners such as bolts, or other equivalent means. Input end plate 12 may be joined to cylindrical case 11 by means of welding mechanical fasteners, or other equivalent means so long as access to the central cavity defined by cylindrical case 11 from one end or the other may be had for assembly of the motor. Mounting support 14 provides convenient protection for output gear 35 attached to output shaft 41, as well as providing a means for mounting the gas powered motor to other structure. Output gear 35 is retained to output shaft 41 by key 37 and set screw 38 in a conventional manner, although any other means of attachment providing equivalent rigidity could be used.

Output shaft 41 is shown in FIG. 1 integral with cylinder head plate 33 which, in turn, is welded or equivalently attached to rotary cylinder 32. Cylinder head plate 33 and rotary cylinder 32 together with output shaft 41 comprise the inner body. Graphite interface 31 which is installed within rotary cylinder 32 before attachment of cylinder head plate 33 also forms a part of the inner body. The inner body is mounted for rotation relative to the housing by bearing 34 which may be a ball bearing assembly or other equivalent bearing, such as a tapered or straight roller bearing. Separate passages 19 and 19' each lead from cylindrical chamber 21 or 21' to a central well occupied by one end of rod 16.

Pressurized gas is delivered to the gas powered motor by pipe 15. The gas enters central passageway 17 within rod 16. Pressurized gas is lead to the surface of rod 16 at the end adjacent the inner body by lateral passageway 18. Rod 16 is fixed in rotational position relative to the housing by pin 24. Other means of fixing rod 16 relative to the housing could be used, such as by providing splines on the end of rod 16 which engage grooves on input end plate 12, or by bolting, welding or otherwise attaching rod 16 to input end plate 12. Thus, lateral passageway 18 occupies a fixed position relative to the housing.

As the inner body rotates on bearing 34, passageway 19', for example, aligns with and communicates with lateral passage 18 through a limited angular displacement. Pivot plate 25, against which conical ends 48 of pistons 27 bear, is mounted on bearing 26 for rotation about an axis which is inclined to the axis of rotation of the inner body on bearing 34. This results in flat annular contact surface 25' being inclined rather than perpendicular relative to the thrust axis of pistons 27 and 27'.

As the inner body rotates, separate passage 19' aligns with lateral passageway 18 and delivers pressurized gas to cylindrical chamber 21'. This gas pressure operates on piston 27' which in turn, bears against pivot plate 25 on flat annular contact surface 25'. This contact occurs at an inclined orientation resulting in unbalanced reaction forces in the direction of rotation of the inner body and pivot plate 25. As this rotation is caused to occur, piston 27' strokes until it reaches the position shown by piston 27. At this point in the cycle, separate passage 19' has moved out of alignment with lateral passageway 18, and pressurized gas no longer is being applied to cylindrical chamber 21'. Actual inlet flow cut off of pressurized gas occurs before the piston reaches the bottom dead center position shown by piston 27 to allow some expansion of inlet gas.

As pivot plate 25 rotates and begins returning piston 27 to its retracted position, gas within cylindrical chamber 21 is exhausted through separate passage 19 and past rod 16 through relieved area 22. Exhausted gas leaving relieved area 22 enters the central cavity of the housing and is vented through exhaust vent 23.

The timing of inlet and exhaust flow is governed by the configuration of lateral passage 18 at the surface of rod 16 and by the configuration of relieved area 22. Lateral passage 18 may advantageously deliver flow to a given separate passageway through an angular displacement of the inner body of approximately sixty five degrees. Slight overlapping of flow to adjacent separate passages may be desireable to prevent dead spots in inlet flow. The inlet flow angle selected should be positioned to begin inlet flow before a piston reaches its top dead center position although optimum timing will be influenced by the number of cylinders, the revolution speed desired and shaft power to be delivered.

Figure 4:
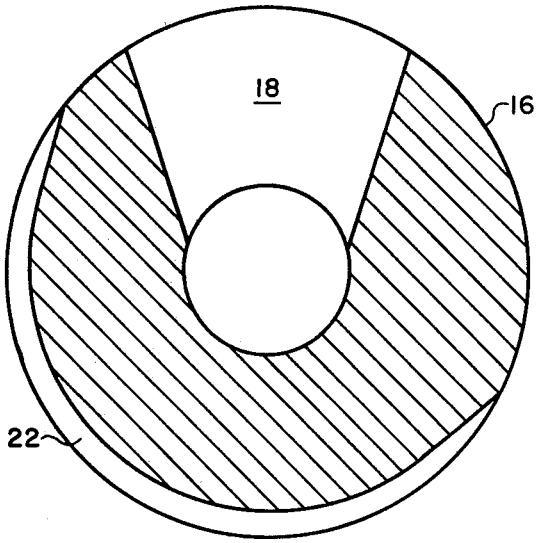
FIG. 4 is a sectional view of rod 16 illustrating inlet and exhaust timing.

Exhaust characteristics are determined by the angular timing and placement of relieved area 22. This configuration should begin the exhaust phase before the piston reaches the bottom dead center position and continue exhausting through approximately two hundred degrees of inner body rotation. The exhaust phase should cease a few degrees before the inlet phase begins again with no overlap between inlet and exhaust. Of course substantial overlapping of exhausting passages will occur and relieved area 22 should therefore be designed to provide adequate flow area. FIG. 4 illustrates a representative inlet and exhaust configuration for rod 16.

Of course such a gas powered motor as described could use any number of piston and cylindrical cavity pairs, either an odd or even number depending upon piston diameter and rotary cylinder diameter. A ten cylinder motor for example would be one practical embodiment, it is, of course, understood that each cylinder and piston operates in sequence as each separate passage 19 passes lateral passageway 18 and relieved portion 22 respectively during each part of the rotational cycle.

Pistons 27 have flattened surface 39 against which pressurized gas acts. Also, sealing rings 28 and 29 prevent execessive leakage of pressurized gas during the power and exhaust strokes. O-ring seal 36 helps seal moisture and dirt out of the motor during storage prior to use.

Sealing between rod 16 and graphite interface 31 is accomplished by machining rod 16 to a closely toleranced dimension for a close fit within interface 31, and by constructing rod 16 from a material having a low thermal coefficient of expansion. Rod 16 may, for example, be constructed of Invar or other material capable of withstanding operating gas pressure and having a low thermal coefficient of expansion.

Timing of the engine is partially determined by the relative rotational placement of rod 16 relative to the housing, and in particular the relative placement of lateral passageway 18 to pivot plate 25. Lateral passageway 18 is configured so that there is a slight overlap between flow into adjacent separate passageways with the result that input flow is almost continuous and no dead spots exist in input flow where input flow velocity is zero. Lateral passageway 18 and separate passages 19 may be positioned to begin input approximately 5° of rotation of rotary cylinder 32 before piston 27' reaches its top center position shown in FIG. 1 by piston 27.

Lateral passageway 18 may be angled from central passageway 17 so that the direction of flow of pressurized input gas undergoes minimum change in direction as it enters each respective cylindrical chamber. Exhaust flow through the same separate passage is directed by relieved portion 22 along the axis of rod 16 into the central cavity and from there out vent 23, likewise minimizing the change in direction of gas required to thereby minimize fluid losses.

Since pivot plate 25 and rotary cylinder 32 do not rotate in the same plane, there is slight relative movement between the connical tips 48 of pistons 27 relative to flat annular contact surface 25'. Conical tips 48 provide clearance between piston 27 and pivot plate 25 except at the apex of the tip and minimize friction by providing only a point contact between piston 27 and pivot plate 25. Pivot plate 25 has flat annular contact surface 25' positioned to lie in a plane which is perpendicular to the axis of rotation of pivot plate 25 and which also contains the point of intersection between the axes of rotation of rotary cylinder 32 and pivot plate 25, respectively.

Figure 2:
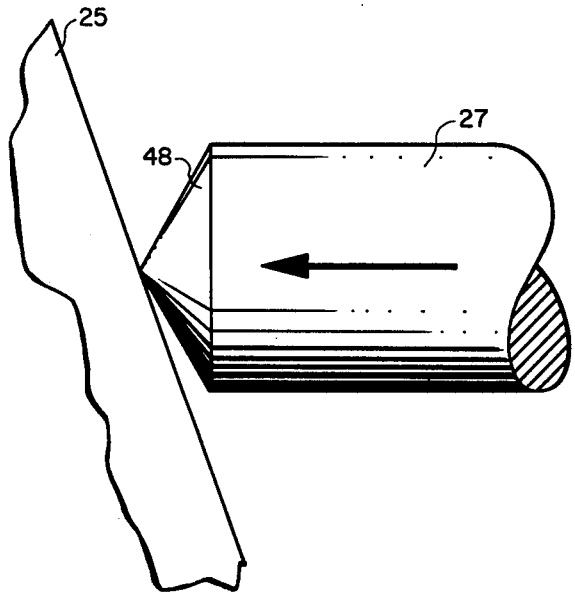
FIG. 2 illustrates the contact orientation between piston 27 and pivot plate 25.
Figure 3:
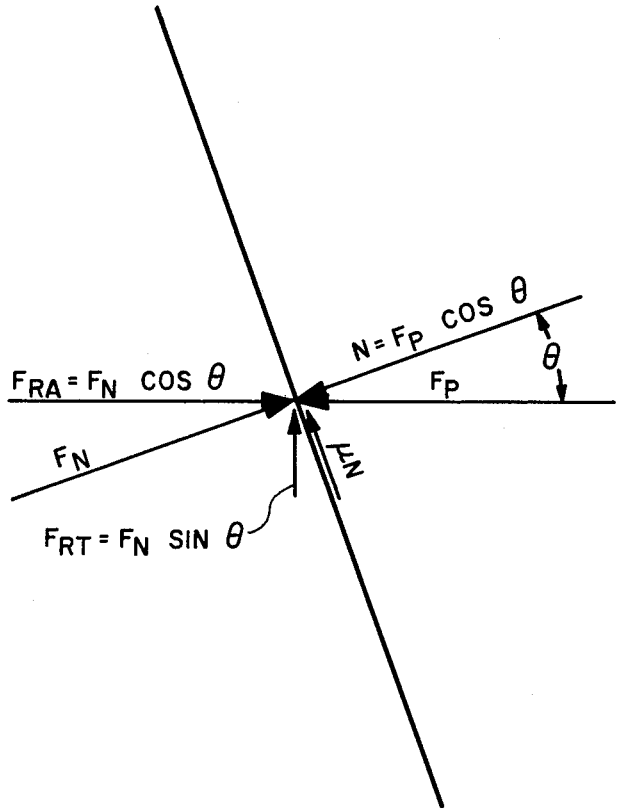
FIG. 3 illustrates the unbalanced forces resulting from the contact shown in FIG. 2 which rotation of pivot plate 25 and rotary cylinder 32.

FIG. 2 shows the point contact between piston 27 and pivot plate 25. FIG. 3 shows the uncountered reaction and frictional forces which cause rotation of pivot plate 25 and rotary cylinder 32 respectively. $F_{RA}$ is the axial reaction force which partially counters $F_p$, the force applied by piston 27. $F_{RA}$ is one component of $F_N$ the reaction normal force which balances the normal component N of $F_p$. The tangential reaction force $F_{RT}$ is uncounted and bears against piston 27 causing rotation of rotary cylinder 32. Meanwhile, the frictional component $\mu N$ of $F_p$ causes rotation of pivot plate 25.

What is claimed is:

1. A gas powered motor comprising:

a housing having a central cavity, a pressurized gas inlet, an exhaust gas outlet and an outlet aperture;

an inner body mounted within said central cavity for rotation about a first axis relative to said housing, said inner body having two ends, an output shaft on one end extending along said first axis through said output aperture, and a plurality of open cylindrical chambers on the other end, said cylindrical chambers being arranged in a circular pattern centered around and aligned parallel with said first axis, and each of said cylindrical chambers being evenly spaced from adjacent cylindrical chambers;

a plurality of pistons, each having a conical end and a flat end, and each piston being sealingly slidable between first and second positions within one of said cylindrical chambers, said conical ends on said pistons extending respectively from each of said cylindrical chambers;

a pivot plate mounted within said housing central cavity for rotation about a second axis, said pivot plate having a flat annular contact surface which is perpendicular to and centered around said second axis and in confronting opposed relationship with the conical ends of said pistons, wherein said second axis intersects said first axis at a point;

a rod having first and second ends and a central passageway which is open on said first end, said rod being aligned with said first axis, said first end being adjacent said pressurized inlet, and said second end being adjacent said inner body, said rod attached to said housing and cooperating with said pressurized gas inlet for conducting a pressurized gas from the exterior of said housing to a point within said central cavity;

a graphite interface located adjacent to said rod and said inner body, said graphite interface being penetrated by said separate passages and containing said terminal points;

valving means cooperating between said rod and said inner body for selectively delivering said pressurized gas from said rod to each of said cylindrical chambers according to a predetermined sequential order, where said rod has a lateral passageway communicating between said central passageway and a point on the surface of said rod adjacent said inner body, and said inner body has a plurality of separate passages, each communicating between a different one of said cylindrical chambers and a different terminal point on the surface of said inner body adjacent said rod wherein said terminal points are spaced from one another and located momentarily adjacent each of said lateral passageways as said inner body rotates relative to said housing, whereby said lateral passageway aligns and communicates with each of said separate passages according to a foresaid predetermined sequential order; and venting means cooperating among said rod, said inner body and said exhaust gas outlet for exhausting gas from said cylindrical chambers to the exterior of said housing according to said predetermined sequential order, said rod has a relieved portion spaced from said lateral passageway and aligned with each of said inner body passage terminal points according to aforesaid predetermined sequential order as said inner body rotates relative to said housing, whereby exhaust of gas within said cylindrical chambers to said central cavity and out through said exhaust gas outlet is enabled; and whereby pressurized gas within said rod is selectively distributed to each cylindrical chamber, in order, driving the conical end of each respective piston into contact with said pivot plate flat annular contact surface, resulting in uncountered reaction forces which cause rotation of said inner body and pivot plate around said first and second axes respectively, thereby enabling stroking of said pistons from said first position to said second position, said pivot plate returning said pistons from said second position to said first position thereby exhausting gas from said cylindrical chambers.

2. A gas powered motor as set forth in claim 1 wherein said pistons each comprise a body portion and two circumferential sealing rings.

3. A gas powered motor as set forth in claim 1 further including an output gear attached to said output shaft.

4. A gas powered motor as set forth in claim 1 wherein said lateral passageway is located relative to said pivot plate to align and communicate with one of said separate passages in said inner body as the piston in the cylindrical chamber with which said one separate passage communicates reaches said first postion.

5. A gas powered motor as set forth in claim 1 wherein said inner body is mounted for rotation relative to said housing by a single row ball bearing assembly.

6. A gas powered motor as set forth in claim 1 wherein said flat annular contact surface lies in a plane which includes said point of intersection of said first and second axes.

* * * * *